United States Patent [19]

Cochran

[11] Patent Number: 4,660,497

[45] Date of Patent: Apr. 28, 1987

[54] BOLTROPE ATTACHMENT OF FLEXIBLE HULL PORTION TO A RIGID HULL PORTION OF AN RIB

[76] Inventor: William H. Cochran, P.O. Box 32, 72 Water St., Stonington, Conn. 06378-0032

[21] Appl. No.: 829,480

[22] Filed: Feb. 14, 1986

Related U.S. Application Data

[63] Continuation of Ser. No. 618,147, Jun. 7, 1984, abandoned.

[51] Int. Cl.[4] ..... B63B 7/00

[52] U.S. Cl. ..... 114/345; 441/40

[58] Field of Search ..... 114/345, 346, 356, 354; 441/40–42

[56] References Cited

U.S. PATENT DOCUMENTS

| | | | |
|---|---|---|---|
| 3,168,751 | 2/1965 | Cavaignac et al. | 114/345 |
| 3,170,174 | 2/1965 | Hanel | 114/345 |
| 3,611,459 | 10/1971 | Sear et al. | 114/345 |
| 3,694,836 | 10/1972 | Serra | 114/345 |
| 3,812,805 | 5/1974 | Forssell | 114/345 |
| 3,851,609 | 12/1974 | Stearn | 114/105 |
| 4,196,687 | 4/1960 | Newick | 114/106 |
| 4,231,131 | 11/1980 | Young | 114/345 |
| 4,251,893 | 2/1981 | McCrory | 114/345 |
| 4,329,751 | 5/1982 | Cigognetti | 114/345 |

FOREIGN PATENT DOCUMENTS

| | | | |
|---|---|---|---|
| 114897 | 3/1942 | Australia | 114/345 |
| 763739 | 7/1967 | Canada | 114/345 |
| 2642967 | 3/1978 | Fed. Rep. of Germany | 114/345 |
| 1407208 | 6/1965 | France | 114/356 |
| 2251469 | 6/1975 | France | 441/40 |
| 2495096 | 6/1982 | France | 441/40 |
| 1313850 | 4/1973 | United Kingdom | 114/345 |
| 1589635 | 5/1981 | United Kingdom | 114/345 |

*Primary Examiner*—Joseph F. Peters, Jr.
*Assistant Examiner*—Jesûs D. Sotelo
*Attorney, Agent, or Firm*—Cushman, Darby & Cushman

[57] ABSTRACT

A rigid inflatable boat (RIB) has a rigid hull portion and a flexible hull portion with a connection between them. The connection is provided by a boltrope, or the like, received in a grooved anchor. The flexible hull portion includes an enclosure, preferably of a conforming fabric, with a number of inflatable bladders enclosed by the fabric. The boltrope is preferably attached to the fabric of the enclosure by textile tape and stitching. The enclosure fabric is impregnated with a finishing material, such as a resin, while in the position it will be in when containing inflated bladders, and is cured in that configuration. A transom is pivotally mounted to the rigid hull portion, and braces hold the transom in an upright position during use. The sides of the transom are scalloped to receive and position the flexible hull portion, and a significant amount of the flexible hull portion extends aft of the transom. A centrally disposed boltrope and grooved lugs may provide a rub strake for the flexible hull portion, and a boltrope at the top of the flexible hull portion may mount accessory components such as cleats, oarlocks, and thwarts. The conforming fabric may be tubular knit fabric spirally wrapped with a second fabric, flat (e.g. warp) knit fabric, non-woven fabric, triaxially woven fabric, or the like.

12 Claims, 15 Drawing Figures

Fig. 12.
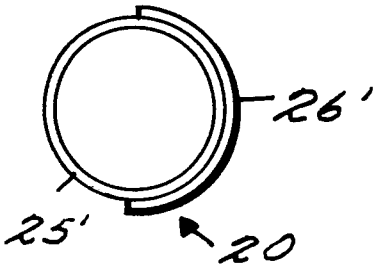
Fig. 13.
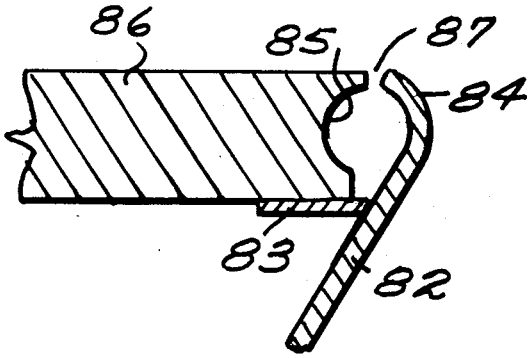
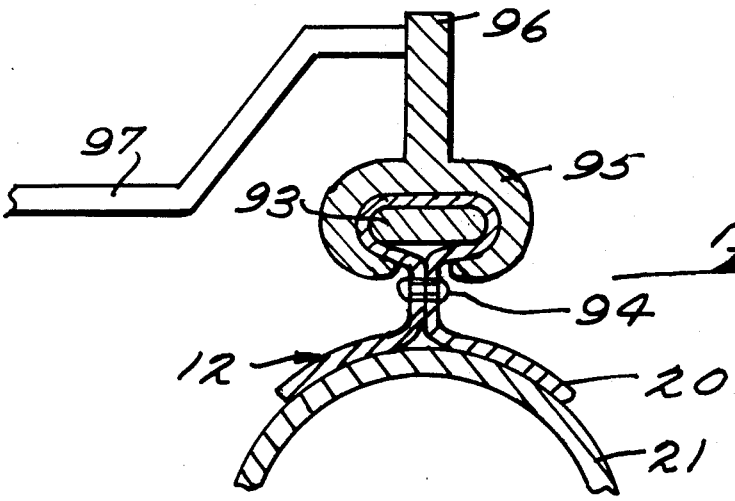
Fig. 15.
Fig. 14.
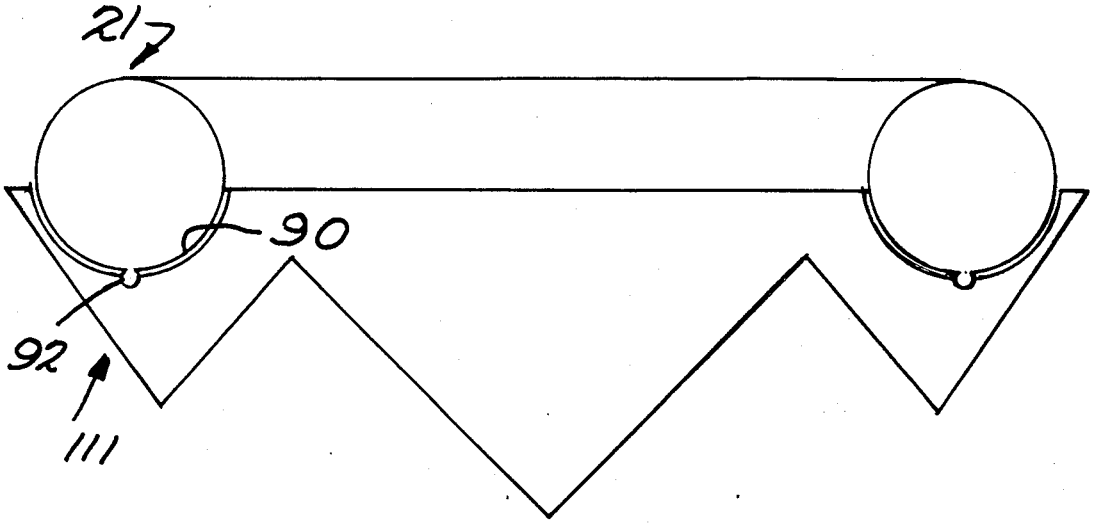

BOLTROPE ATTACHMENT OF FLEXIBLE HULL PORTION TO A RIGID HULL PORTION OF AN RIB

This is a continuation of application Ser. No. 618,147, filed June 7, 1984, which was abandoned upon the filing hereof.

BACKGROUND AND SUMMARY OF THE INVENTION

Rigid inflatable boats (commonly known as RIBs), are useful in rescue operations, especially in heavy seas, and in a variety of other environments where the good stability, buoyancy, and other properties of these boats are particularly advantageous. In U.S. Pat. No. 4,498,413 a rigid inflated boat has been described which is relatively simple to construct, versatile, relatively inexpensive, and easy to transport. In preferred embodiments illustrated in said applications, the boats have rigid hull portions generally at and below the water level, and flexible hull portions generally at and above the water level. The flexible portion comprises a flexible material, preferably an abrasion resistant fabric, which circumferentially surrounds a plurality of inflatable bladders.

The present invention relates to improved constructions of the rigid inflatable boats illustrated in and described in said co-pending applications, and utilizing the basic concepts of a rigid hull portion and a flexible hull portion. According to the present invention, an eminently practical RIB construction is provided which facilitates the modular construction of a rigid inflatable boat, provides desired stability and other functional characteristics while allowing the boat to be transported or stored in a minimum volume configuration, and utilizes materials that are eminently suited for use as the enclosure for the bladders.

According to one aspect of the present invention, a rigid inflatable boat is provided which includes: a rigid hull portion disposed generally at, and below, the water level of the hull; a flexible hull portion, the flexible hull portion including an enclosure or shroud of flexible material completely circumferentially surrounding a plurality of inflatable bladders, and the flexible hull portion being positioned generally at, and above, the water level of the hull; and connecting means for connecting the flexible hull portion to the rigid hull portion, the connecting means comprising bead means formed on the flexible hull portion, and grooved anchor means formed on the rigid hull portion, and for cooperating with the bead means of said flexible hull portion. The bead means preferably comprises a boltrope or the like, and the grooved anchor means preferably has a C-shape in cross-section.

The enclosure for the bladders, of the flexible hull portion, preferably is of a conforming fabric. The term "conforming fabric" as used in the present specification and claims relates to a fabric that has properties such that it may be formed to the required complex contour without puckering. The majority of conforming fabrics are knit, such as warp knit or circular knit fabrics. However triaxially woven fabric, fabrics woven with elastic therein, velvet, and braided fabric also are conforming fabrics. The enclosure fabric is preferably attached to the boltrope by textile tape and stitching.

It is particularly advantageous to provide memory for the conforming fabric of the enclosure so that it tends to return to its use position, wherein it completely circumferentially encloses inflated bladders. This may be accomplished by impregnating the fabric with a finishing material, such as a resin, and curing it while it is held in its desired use position.

According to another aspect of the present invention, a rigid inflatable boat includes a transom, the transom providing for proper positioning of the flexible hull portion. The sides of the transom may be scalloped to receive the flexible hull portion, and the boltrope may be affixed to the rigid hull portion in the area of the transom. Preferably, the transom is pivotally mounted to the rigid hull portion for pivotal movement about a horizontal axis extending along the dimension of elongation of the transom, so that the transom may be folded down so that the boat will assume a low volume configuration during storage or transport. A brace attached to the rigid hull portion and the transom holds the transom in an upright position during use, and positioning of the flexible hull portion may be facilitated by loosely affixing the enclosure fabric to the brace.

It is the primary object of the present invention to provide a practical, versatile, RIB. This and other objects of the invention will become clear from an inspection of the detailed description of the invention, and from the appended claims.

BRIEF DESCRIPTION OF THE DRAWINGS

FIG. 12 is an end schematic view illustrating another manner of constructing an exemplary fabric enclosure for the flexible hull portion of the boat according to the invention;

FIG. 13 is a detail cross-sectional view of another embodiment of an exemplary anchor for use with the boltrope of FIG. 1;

FIG. 14 is an end view of another embodiment of an exemplary boat according to the present invention; and FIG. 15 is a detail end view, partly in cross-section and partly in elevation, of another use of the boltrope concept according to the invention, for the mounting of accessory components.

DETAILED DESCRIPTION OF THE DRAWINGS

Attention is directed to U.S. Pat. No. 4,498,413 and co-pending application Ser. No. 572,372 filed Jan. 20, 1984, the disclosures of which are hereby incorporated by reference herein. The invention relates to an improvement for a rigid inflatable boat of the type generally shown in said co-pending application, wherein there is provided a rigid hull portion 11, and a flexible hull portion 12 (see FIGS. 3 through 5) of an RIB 10.

Figure 2:
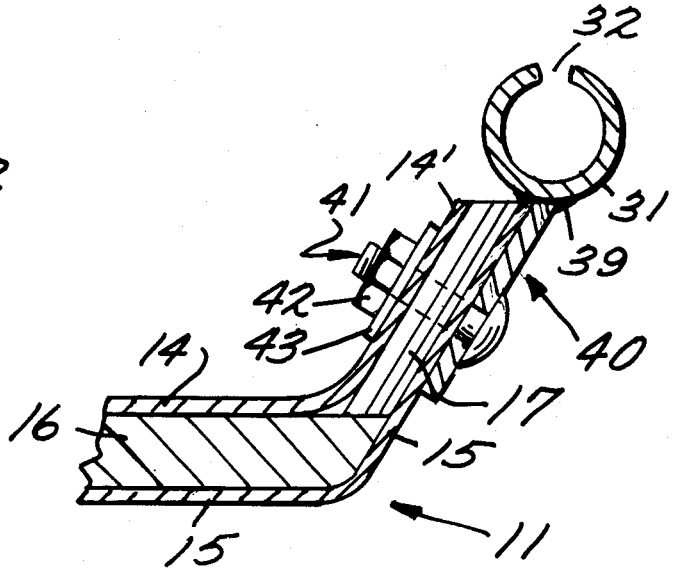
FIG. 2 is a side view, partly in cross-section and partly in elevation, of an anchor means associated with the rigid portion of the hull of a boat, and utilizable with the boltrope of FIG. 1.
Figure 3:
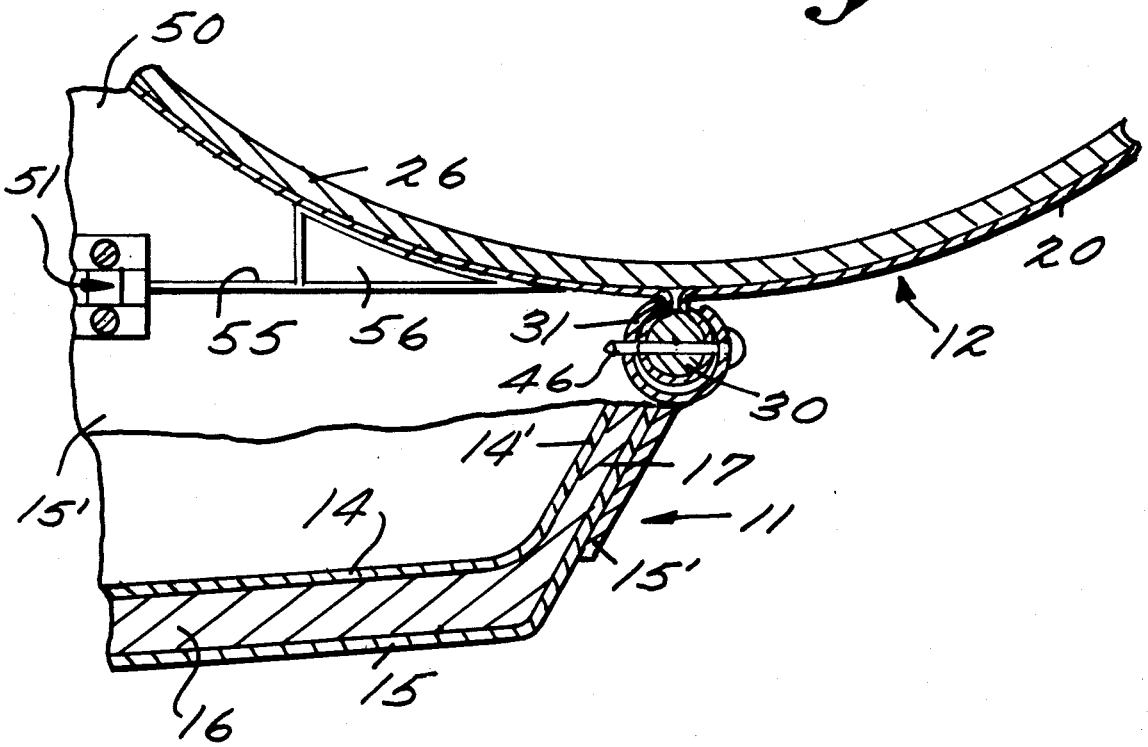
FIG. 3 is a side view, partly in cross-section and partly in elevation, showing a portion of an exemplary RIB according to the invention, adjacent the transom.
Figure 6:
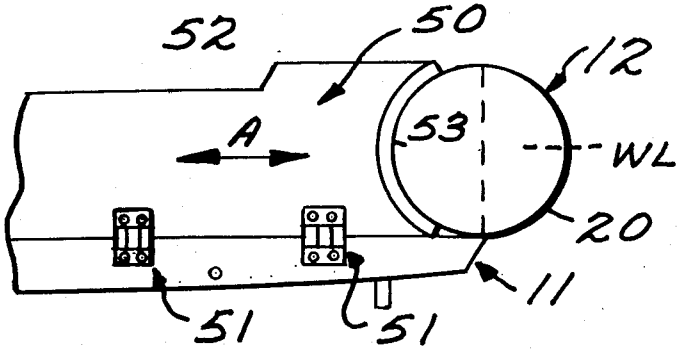
FIG. 6 is a rear end view of the portion of the boat illustrated in FIG. 4.

The rigid portion 11 of the boat 10 is disposed generally at and below the water line WL (see FIG. 6) of the boat, while the flexible portion 12 is disposed generally at and above the water line WL. The rigid hull portion 11 may take any desired form, a number of configurations of which are illustrated in said application Ser. No. 572,372. One particularly advantageous form the rigid hull portion 11 may take is illustrated in FIGS. 2 and 3, and comprises upper and lower fiberglass shells 14, 15 filled with a solid buoyant material, such as foam, cork, or the like, 16. The shells 14, 15 also include side portions 14', 15' thereof, and foam, or plywood 17, may be disposed between the portions 14', 15'. Alternatively those portions 14', 15' may mate and be ultrasonically welded, glued, or otherwise attached together. In the embodiment of the boat 10 illustrated in the drawings, the sole is generally flat, although a wide variety of other configurations also may be provided.

Figure 1:
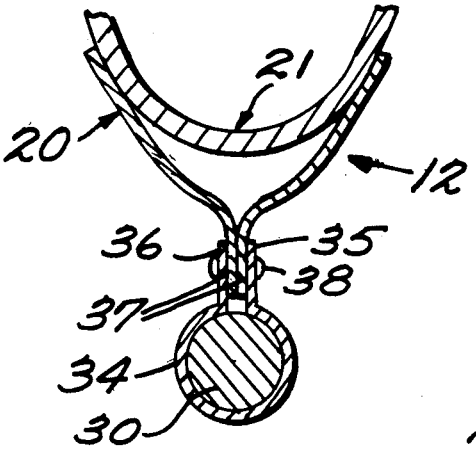
FIG. 1 is a partial cross-sectional view showing an exemplary interconnection between a bladder enclosure fabric and a boltrope.
Figure 5:
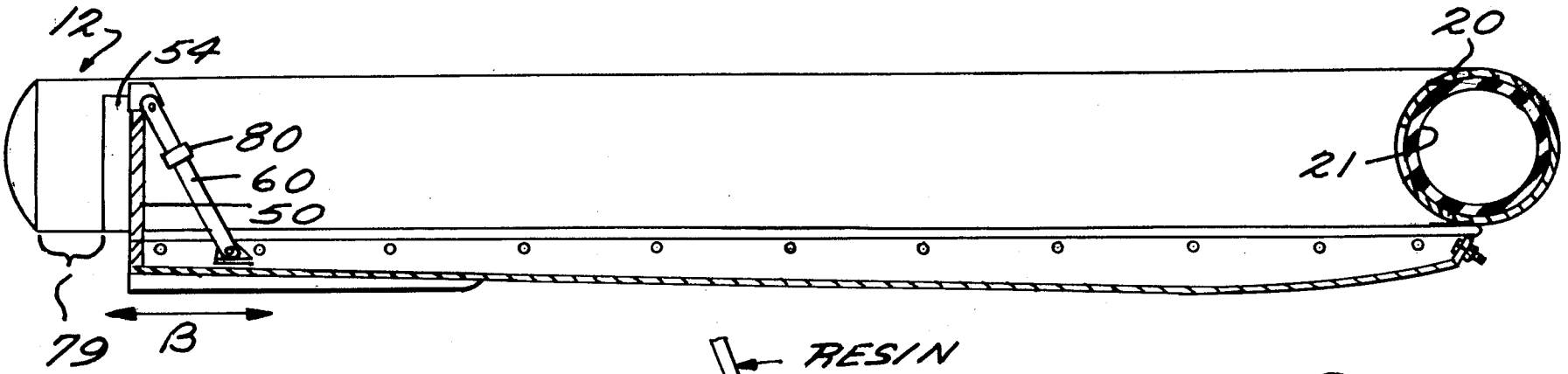
FIG. 5 is a side view of the boat of FIG. 4, taken along lines 5—5 thereof.

The flexible portion 12 of the hull of the boat 10 according to the present invention includes an enclosure or shroud 20 of flexible material, which enclosure completely circumferentially surrounds a plurality of bladders 21 (see FIGS. 1, 3, and 5 in particular). The bladders 21 may be formed of elastomeric material or the like, and different constructions and varieties of bladders are more fully described in said application Ser. No. 572,372.

The enclosure 20 may be formed of almost any flexible material that is capable of performing a protecting function, and properly positioning the bladders 20 in place during use, and in some situations the bladder and enclosure may even be made integral. While enclosure 20 may be made of unsupported plastic, supported rubber, woven nylon, nonwoven textiles, precoated or prefinished textiles, in-situ coated or finished textiles, or the like, preferably the enclosure 20 is formed of a conforming fabric. Typical conforming fabrics include circular knit fabrics, flat (e.g. warp) knit fabrics, felts, needlepunched fabrics, non-woven fabrics, triaxially woven fabrics, velvet, fabrics woven with elastic, and braided textiles. It is desirable for the fabric of the enclosure 20 to have "memory" to its use position (see FIGS. 4 through 6 in particular) wherein it completely circumferentially surrounds an inflated bladder. This may be accomplished by impregnating the conforming fabric with a resin, or like finishing agent, while it is in its inflated position, and curing it in that position; or by cutting and sewing a conforming fabric, or non-conforming fabric, into the desired shape. In this regard attention is particularly directed to FIG. 11 which shows a former 24 on which a length of conforming fabric 25 is disposed, and the resin therein cured.

Figure 11:
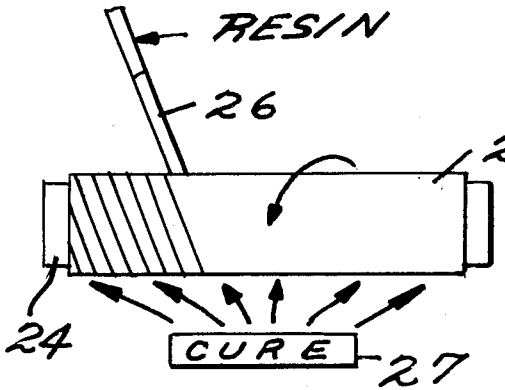
FIG. 11 is a schematic view illustrating a manner of the construction of an exemplary fabric enclosure, for the flexible hull portion of a boat according to the invention.

FIG. 11 more particularly illustrates the construction of a specific enclosure 20 material wherein a second fabric, such as a fabric 26 having stretch properties, is spirally wrapped around the fabric 25. The second fabric 26 is impregnated with resin, or like finishing agent, and after construction of the final fabric is subjected to cure by a heat source 27, or the like, to provide an integral final fabric which serves well as the enclosure 20 after it is removed from the former 24. During use, preferably the fabric constructed according to FIG. 11 is inverted so that the spirally developed second fabric 26 is disposed on the interior of the final fabric, and the fabric 25 on the outside.

FIG. 12 illustrates the construction of another specific enclosure material 20 that has "memory" to a use position wherein it completely circumferentially surrounds an inflated bladder. In this embodiment the first fabric 25' is disposed on a former, and then a second fabric 26' is disposed along a part of the circumference thereof, and along a substantial part of the length thereof. The fabrics 25', 26' are attached together in any desired way. For instance the fabric 26' may be impregnated with resin, or like finishing agent, and cured. As in the FIG. 11 embodiment, the fabric 20 in FIG. 12 may be inverted before use.

According to the present invention, particular connecting means are provided for connecting the flexible hull portion 12 to the rigid hull portion 11. The particular connecting means according to the present invention comprises bead means, such as boltrope 30 (see FIGS. 1 and 3 in particular) and cooperating grooved anchor means, such as the anchor portion 31 (see FIGS. 2 and 3) which is C-shaped in cross-section with the groove 32 therein generally facing upwardly and extending generally horizontally. Of course other bead means and grooved anchors may be provided, but the boltrope is particularly advantageous.

The boltrope 30 may be connected to the enclosure 20 by any suitable means. Preferably, as illustrated in FIG. 1, a length of textile tape 34, which extends substantially the entire length of the boltrope 30, is wrapped around it, and the end portions 35, 36 thereof are stitched to end portions 37 of the enclosure 20 sandwiched therebetween, the stitching shown generally by reference numeral 38. The textile tape 34 may be of any conventional material, preferably an abrasion resistant material that will not degrade when exposed to sunlight, such as a woven polyester fabric, or nylon.

The anchor portion 31 preferably is part of an aluminum or plastic extrusion, and it may be welded or otherwise attached—as indicated at 39 in FIG. 2—to a plate 40 (e.g. an aluminum plate). Alternatively a construction of the anchor can be devised wherein a single aluminum or plastic extrusion can be provided for the elements 39, 40.

The anchor preferably is attached to the side portions 14', 15' of the rigid hull portion 11 by one or more fasteners, such as bolt 41 in FIG. 2, which engages the plate 40 and, through nut 42 and washer 43 which engages the inner shell portion 14'.

The anchor 31 is continuous around the circumference of the boat, except at the transom (50), and is preferably secured approximately every 12 inches along the periphery of the rigid hull portion 11 thereof by a bolt 41, etc. Preferably no bolt 41 is provided at the center line of the bow of the boat, but rather a towing eye is provided at the center line of the bow. The anchor 31 may occasionally be discontinuous to receive clamps, cleats, or the like, if desired.

It is desirable to affix the boltrope 30 with respect to the rigid hull portion 11 once it has been threaded through the anchor 31. Inflation of the bladders can effect affixation if the rigid hull portion 11 is properly shaped (e.g. see FIG. 14). Affixation may be accomplished by any of a wide variety of other means, such as by extending portions of the boltrope 30 past the ends of the enclosure 20 or tape 34, and attaching those extending ends of the boltrope by any of a wide variety of clamps or cleats, to the fixed hull portion 11. Alternatively the clamps or cleats can be provided where the anchor 31 is discontinuous, and clamping may be effected at intermediate positions along the length of the boltrope and anchor, as well as at the ends thereof. Another boltrope anchoring means, which is illustrated in FIG. 3, comprises a screw 46 passing through anchor 31 adjacent the stern of the boat, and passing through the boltrope at that point to thereby hold the boltrope 30 stationary with respect to the rigid hull portion 11.

The boat 10 according to the present invention also preferably comprises a transom. The transom preferably comprises a plate 50 (see FIGS. 3 through 6) of relatively rigid material, such as fiberglass, wood, or aluminum, and desirably is pivotally connected to the rigid hull portion 11. This may be accomplished by hinge means 51 (see FIGS. 3 and 6) which allow pivotal movement of the transom 50 with respect to the rigid hull portion 11 about a generally horizontal axis extending in the dimension of elongation A—A of the transom 50. The transom 50 preferably includes a central portion 52 thereof which is ideal for mounting a motor, or the like, and includes side portions 53, 54 (see FIGS. 4 through 6) which are scalloped to provide a contour in which the flexible hull portion 12 seats. The scalloped portions 53, 54 preferably extend a substantial distance in the dimension B which is along the side of the boat 10, and generally perpendicular to the plane of the transom 50.

Preferably at the hinge line between the rigid hull portion 11 and the transom 50 a rubber gasket 55 (see FIG. 3) is provided to prevent water from leaking into the boat once the transom 50 has been moved to its in-use, generally upright position (as illustrated in FIGS. 3 through 6). Also, to facilitate the contour of the transom 50 to the flexible hull portion 11, a filler block 56 (see FIG. 3) is fixed to the transom 50, as by nailing and gluing, or fixed to the rigid hull portion 11.

Figure 4:
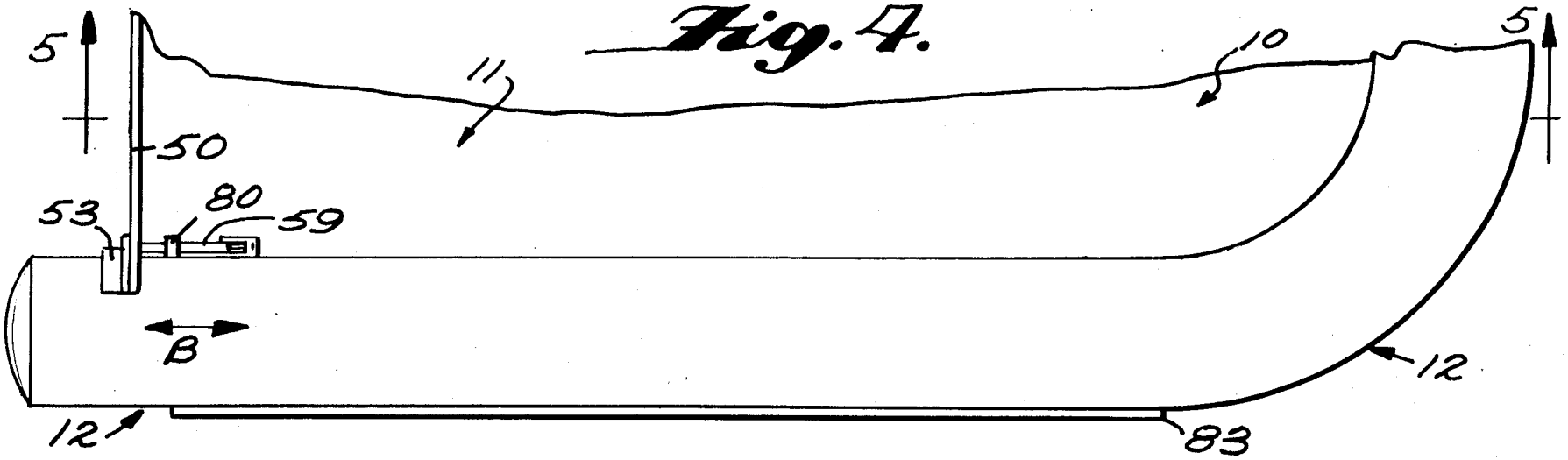
FIG. 4 is a top plan view of the right half of an exemplary RIB according to the present invention.
Figure 7:
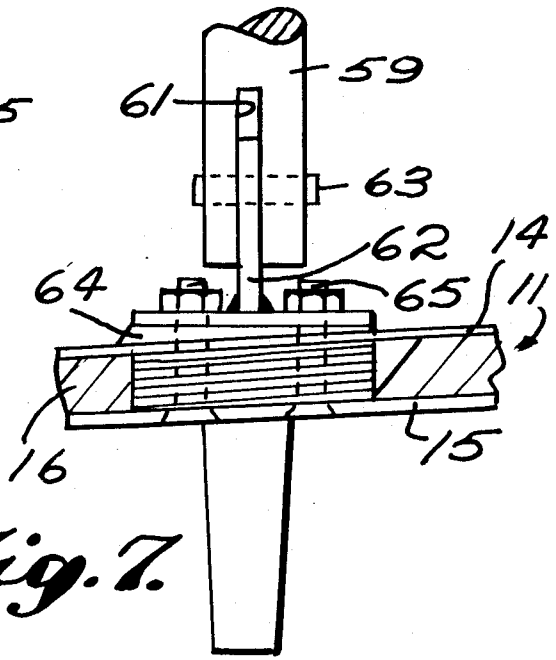
FIG. 7 is a detail view, partly in cross-section and partly in elevation, showing an exemplary form of connection of the transom brace to the boat sole for the boat of FIGS. 4 through 6.

To hold the transom 50 in its operative upright position, brace means are provided, such as the two spaced braces 59, 60 illustrated in FIGS. 4 and 5 respectively. Each of the braces 59, 60 preferably comprises an aluminum rod which has a designed length, cooperating with the fittings therefor, so that the transom 50 is held in a substantially vertical position during use. As illustrated most clearly in FIG. 7, one form that the brace 59 or 60 may take is a rod having a slot 61 formed at the bottom end thereof, and another slot (not shown) formed at the top thereof. A flange 62 extends into the slot 61 and pivotal attachment between the components 59, 62 is provided by a pin 63 passing through the slotted end of the brace 59 and the flange 62. The flange 62 may be affixed to the sole of the rigid hull portion 11 utilizing the block 64, and a plurality of suitable fasteners 65.

Figure 8:
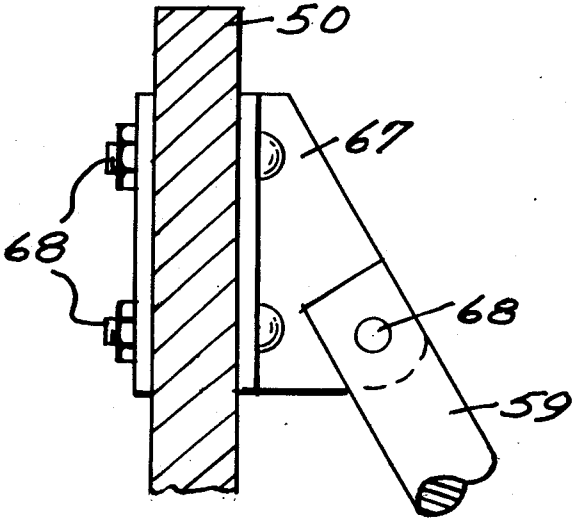
FIG. 8 is a side view, partly in cross-section and partly in elevation, of an exemplary connection between the brace and transom of the boat of FIGS. 4 through 6.

As illustrated in FIG. 8, the top slotted end of the brace 59 receives the flange 67 therein, and a pin 68 connects the components 59, 67 together in the same way that the pin 63 attaches the components 59, 62 together. The flange 67 is attached to the transom by a plurality of suitable fastening means, such bolts 68, for instance two bolts 68 provided on either side of the flange 67.

Figure 9:
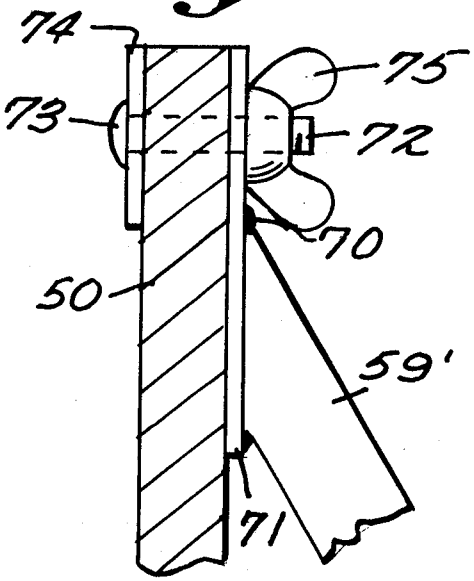
FIG. 9 is a view like FIG. 8 only showing an alternative interconnection of a brace to a transom.

FIG. 9 illustrates an alternative way in which a brace may be mounted to the transom (or sole). In FIG. 9, the brace 59' does not contain a slotted end, but rather it is welded, as indicated by reference numeral 70, to a plate 71. The plate 71 includes an opening (not shown) therein which is adapted to receive a screw 72 therein. When the screw 72 is passed through the opening in the plate 71, with the head 73 of the screw of 72, and a washer 74 engaging the face of the transom 50 opposite the brace 59', a wing nut 75 is then screwed into operative association with the screw 72, to hold the brace 59' in place.

Since there is a pivotal connection between the transom 50 and the rigid hull portion 11, by removing the braces 59, 60 the transom 50 may be folded into, or out of, the boat (depending upon the particular location and orientation of the hinges 51), or the transom may be removed by removal of the hinge pins, so that the boat may assume a low volume configuration for ease of transport or storage.

As will be seen most clearly in FIGS. 4 and 5, the transom 50 helps position the flexible hull portion 12 at the aft portion thereof. In order to facilitate this positioning, and so that a fendering action is provided, preferably a significant portion—i.e. portion 79 in FIGS. 4 and 5—of the flexible hull portion 12 extends aft of the transom 50. Also to facilitate positioning of the flexible hull portion 12, it is loosely attached to the braces 59, 60. This may be accomplished by providing a ring 80 (see FIGS. 4 and 5) on each of the braces 59, 60 which can slide up and down on the ring, to which ring a portion of fabric is attached, which in turn is sewn to the fabric providing part of the enclosure 20. A substantial amount of play (e.g. 10°) must be provided at this attachment in order to facilitate removal of the braces 59, 60.

In order to extend the life of the flexible hull portion 12 at the aft portions thereof, preferably extra layers of fabric are provided as part of the enclosure 20 at the portions thereof adjacent the transom 50. These extra layers preferably are provided both at the portion of the enclosure 20 which abuts the scalloped transom portions 53, 54, and to which the rings 80 are attached.

If desired, intermediate positioning components can also be provided along the sides of the boat 10 to properly position the flexible hull portion 12 with respect to the rigid hull portion 11.

Figure 10:
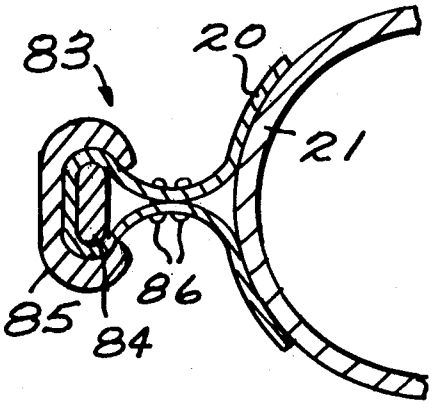
FIG. 10 is a detail cross-sectional view showing a rub strake including a boltrope, which may be utilized with the boat according to the present invention.

According to another aspect of the present invention, a simple yet effective rub strake may be provided, such as illustrated generally by reference numeral 83 in FIG. 4. The rub strake may extend along only a portion of the flexible hull portion 12, or along the entire side circumference thereof. The rub strake 83 is seen more clearly in FIG. 10, and comprises a boltrope 84 which receives a grooved lug, or a plurality of adjacent lugs, 85 formed of some sort of a resilient material (such as rubber or a soft plastic). FIG. 10 also illustrates another form—besides that illustrated in FIG. 1—for attaching a boltrope to the fabric enclosure 20. As illustrated in FIG. 10, the fabric enclosure 20 is a conforming fabric, or the like, and the boltrope 84 is merely disposed in a looped portion thereof, and sewn in place by stitching 86, a single continuous fabric portion thus completely surrounding the boltrope 84 and the bladders 21.

While the flexible hull portion 12 may be disposed along any desired percentage of the circumference of the rigid hull portion 11 (depending upon the construction of the portion 11), in the preferred embodiment illustrated in the drawings the flexible hull portion 12 extends along the entire circumference of the rigid hull portion 11 except along the transom 50.

FIGS. 13 and 14 illustrate alternative constructions of the anchor for the boltrope associated with the flexible hull portion 12. In both FIGS. 13 and 14 the anchor is formed as part of the rigid hull portion. For instance in FIG. 13, the part 82 of the rigid hull portion, which includes an interiorly formed shelf 83, has an arcuate upper portion 84. This cooperates with a complimentary arcuate cut-out 85 in the deck 86, the arcuate portions 84, 85 having the upwardly facing groove 87 therebetween, and adapted to receive the boltrope of FIG. 1 therein. Preferably the hull portion 82 is made of fiberglass or aluminum, and the deck 86 of fiberglass or a core material.

In the FIG. 14 embodiment, a continuous semi-circular depression 90 is formed at peripheral sections of the rigid hull portion 111 (except a depression 90 normally is not provided at the stern of the boat). At the bottom of the depression 90 is formed an upwardly facing C-shaped groove 92, which receives the boltrope associated with the flexible hull portion 21.

The boltrope concept can also be utilized to mount accessory components on the upper part of the flexible hull portion 12. In the FIG. 15 embodiment, the boltrope 93 is held to the enclosure fabric 20 by stitching 94 or the like, and is received by a C-shaped lug 95. The lug 95 has extending upwardly therefrom a suitable component adapting the structure for its intended use. For instance the lug 95 may have a cleat or oarlock component extending upwardly therefrom. Alternatively, as illustrated in FIG. 15, a mounting projection 96 for a thwart extends upwardly from the lug 95, with the thwart 97 being attached at each end thereof to a component 96. Note that the thwart 97 in addition to performing a seat function also provides a positioning function for the flexible hull portion 12. Of course other accessory components may also be provided associated with the lug 95, as desired.

In a typical construction and use of a boat 10 according to the invention, with the bladders 21 deflated the user takes one end of the boltrope 30, threads it through the anchor 31 with the groove 32 in the anchor 31 loosely receiving the plies 35–37 therein, until the flexible portion 12 is disposed around the entire circumference of the rigid hull portion 11 except for the transom 50. The boltrope 30 is then attached at either end thereof in this position, as by utilizing screws 46 (see FIG. 3), or other structures previously described.

The transom 50 is pivoted about hinges 51 so that it is in the upright position, the braces 59 and 60 are attached to the transom 50, as by passing a pin 68 through an upper end of each of the braces 59, 60 and a flange 67 received thereby, so that the transom is held in this upright position, properly positioning the enclosure 20. Then the bladders 21 are inflated by any suitable means such as shown in said co-pending applications. A motor may be mounted at the portion 52 of the transom 50 (either before or after it is mounted in an upright position), and the boat 10 used for any desired purpose.

It will be seen that according to the present invention the utilization of the boltrope allows modular construction of the flexible hull portion 12, ready interchangeability of components, ready mounting of accessories, a low volume configuration for storage, and ease of removal for repair or replacement.

It will thus be seen that according to the present invention a simple, versatile, and effective RIB has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A boat having a hull and comprising: a rigid hull portion disposed generally at, and below, the water level of the hull;

a flexible hull portion, said flexible hull portion including an enclosure of flexible material, said enclosure completely circumferentially surrounding a plurality of inflatable bladders; said flexible hull portion being positioned generally at, and above, the water level of the hull; and connecting means for connecting said flexible hull portion to said rigid hull portion, said connecting means comprising a boltrope connected to said flexible hull portion along its length, said rigid hull portion having anchor means for engaging and holding said boltrope substantially along the entire length of said boltrope, said anchor means comprising a substantially C-shaped channel, said channel having and said boltrope having interconnecting restraining means to prevent relative displacement between said channel and said boltrope regardless of the condition of said inflatable bladders, said enclosure comprising a fabric, and further comprising a rub strake formed around at least a portion of the side of said flexible hull portion, said rub strake being formed by a boltrope secured to said enclosure at said side of said flexible hull portion, and a grooved lug of resilient material receiving said boltrope and disposed outwardly of said enclosure.

2. Apparatus as recited in claim 1 wherein said fabric comprises a conforming fabric, and wherein said boltrope is operatively connected to said conforming fabric by textile tape of an abrasion resistant material, the textile tape surrounding the boltrope and attached to the conforming fabric by stitching.

3. Apparatus as recited in claim 1 wherein said fabric is a tube of fabric, comprising a conforming fabric, and wherein said conforming fabric surrounds said boltrope and is stitched adjacent the points where it surrounds said boltrope, so that the boltrope is held in place.

4. Apparatus as claimed in claim 1 wherein said interconnecting means comprises a pin member extending through said boltrope and said anchor portion.

5. Apparatus as recited in claim 1 wherein said fabric comprises a conforming fabric formed from a first conforming fabric spirally wrapped with a second fabric, the first and second fabrics being operatively held together by a finishing agent.

6. Apparatus as recited in claim 1 wherein said fabric comprises a conforming fabric, and further comprising means for mounting accessory components extending upwardly from said flexible hull portion, said means comprising a boltrope secured to said enclosure at the top of said flexible hull portion, and a grooved lug receiving said boltrope, said grooved lug including a projection extending upwardly from said flexible hull portion.

7. Apparatus as recited in claim 1 wherein said fabric comprises a conforming fabric selected from the group consisting essentially of circular knit fabrics, conforming fabrics with a second fabric adhered thereto to impart memory, braided fabrics, flat knit fabrics, velvet, triaxially woven fabrics, felts, needlepunched fabrics, non-woven fabrics, woven fabrics containing elastic, and combinations thereof.

8. Apparatus as recited in claim 1 wherein said fabric is selected from the group consisting essentially of circular knit fabrics, first and second fabrics adhered together, braided fabrics, flat knit fabrics, velvet, triaxially woven fabrics, felts, needlepunched fabrics, non-woven fabrics, woven fabrics containing elastic, and combinations thereof.

9. Apparatus as recited in claim 1 wherein said boltrope is operatively connected to said enclosure by textile tape of an abrasion resistant material, the textile tape surrounding the boltrope and attached to the flexible material of the enclosure by stitching.

10. Apparatus as recited in claim 1 wherein said fabric is a tube of fabric, and wherein said fabric surrounds said boltrope and is stitched adjacent the points where it surrounds said boltrope, so that the boltrope is held in place.

11. Apparatus as recited in claim 1 wherein said fabric is capable of conforming to the shape of the inflated bladders, said fabric having been impregnated by a finishing material when in a configuration comparable to its configuration when surrounding said inflated bladders so that the conforming enclosure fabric will tend to retain its configuration conforming to the inflated bladders.

12. A boat having a hull, and comprising:

a rigid hull portion disposed generally at, and below, the water level of the hull;

a flexible hull portion, said flexible hull portion including an enclosure of flexible material, said enclosure completely circumferentially surrounding a plurality of inflatable bladders; said flexible hull portion being positioned generally at, and above, the water level of the hull;

connecting means for connecting said flexible hull portion to said rigid hull portion including a C-shaped clamp fixed to said rigid hull portion and a boltrope flexibly connected to said hull portion with means fixedly interconnecting said clamp and said boltrope to prevent relative sliding movement between said clamp and said boltrope;

a transom removably connected to said rigid hull portion for movement relative to said rigid hull portion;

transom brace means operatively connected to said transom and said rigid hull portion for holding said transom in a generally upright position and preventing movement thereof relative to said rigid hull portion; and said brace means being loosely secured to said enclosure material to facilitate proper positioning of said enclosure.

* * * * *